US006595827B2

(12) United States Patent
Kirley

(10) Patent No.: US 6,595,827 B2
(45) Date of Patent: Jul. 22, 2003

(54) SWINGING TOY

(76) Inventor: Lance A. Kirley, 56 Crescent St., Northampton, MA (US) 01060

( * ) Notice: Subject to any disclaimer, the term of this patent is extended or adjusted under 35 U.S.C. 154(b) by 0 days.

(21) Appl. No.: 09/942,523

(22) Filed: Aug. 29, 2001

(65) Prior Publication Data

US 2002/0061705 A1 May 23, 2002

Related U.S. Application Data

(60) Provisional application No. 60/228,350, filed on Aug. 28, 2000.

(51) Int. Cl.[7] ..... A63B 21/00

(52) U.S. Cl. ..... 446/219; 446/247; 446/265; 273/330; 482/110

(58) Field of Search ..... 446/236, 247, 446/253, 254, 265, 175, 219, 397, 266; 273/329, 330, 457; 482/110

(56) References Cited

U.S. PATENT DOCUMENTS 3,439,446 A * 4/1969 Alonso ..... 446/247
5,087,220 A * 2/1992 Cotita ..... 119/719
5,399,136 A * 3/1995 Bart ..... 446/242

* cited by examiner

*Primary Examiner*—Jacob K. Ackun
(74) *Attorney, Agent, or Firm*—Deborah A. Basile

(57) ABSTRACT

The present invention is a swinging toy intended for the purpose of recreation, physical and mental health, agility and leisure purposes. The present invention includes a padded object and a cord with a hand or finger loop. The object includes a central cavity that may selectively or permanently contain a substance. The substance may include colored water, beads which may glow in the dark, chemiluminescent fluid, batteries together with a light, reflective material, e.g, tin foil, chemical compositions that alternate between colors or other such substances, or magnetically powered light sources. Further, a decorative tail may be attached to the end of the object to enhance the user's enjoyment of the toy.

16 Claims, 2 Drawing Sheets

SWINGING TOY

CROSS-REFERENCE TO RELATED APPLICATIONS

Provisional Patent Application Ser. No. 60/228,350 filed Aug. 28, 2000.

Assigned to Lunar Poi, LLC by a document dated Jun. 19, 2001.

STATEMENT REGARDING FEDERALLY SPONSORED RESEARCH AND DEVELOPMENT

Not Applicable.

MICROFICHE APPENDIX

Not applicable.

BACKGROUND OF THE INVENTION

1. Field of the Invention

The present invention is a swinging toy intended for the purpose of recreation, physical and mental health, agility and leisure purposes. The present invention includes a padded object and a cord with a hand or finger loop. The object includes a central cavity that may selectively or permanently contain a substance. The substance may include colored water, beads which may glow in the dark, chemiluminescent fluid, batteries together with a light, reflective material, e.g, tin foil, chemical compositions that alternate between colors or other such substances, or magnetically powered light sources. Further, a decorative tail may be attached to the end of the object to enhance the user's enjoyment of the toy.

2. Description of Related Art

Currently in the field of art, there are swinging toys that are illuminated but are constructed of hard plastic. Other swinging toys are constructed of soft plastic but are not lighted. Yet other swinging toys are not sufficiently aerodynamic to be effective. The present invention combines padding, illumination, and aerodynamic qualities. The prior art does not teach this combination of features.

BRIEF SUMMARY OF THE INVENTION

The swinging toy consists of an object and a cord attached to the object. The object includes at least one cavity that may selectively or permanently contain a substance. The cavity may contain any suitable substance that provides a decorative effect when the toy is in use. These substances may include colored water, beads which may glow in the dark, chemiluminescent fluid, batteries together with a light, reflective material, e.g, tin foil, chemical compositions that alternate between colors or other such substances.

The cavities may range in size and location depending upon the number of cavities desired and aesthetic factors. The cavity is sized and shaped to provide space for a substance and to receive either a permanent or selectively removable end cap. The permanently or selectively removable end cap seals the cavity. The seal between the end cap and the object should provide a watertight seal enclosing the cavity.

The cord may be between 12" and 36" in length and may be of any material strong enough to withstand the forces encountered when the object is twirled. Suitable materials include, nylon cord, cable, metal chain string, fibrous cord, or other suitable elongated member. The cord may be connected to the object through tabs with apertures or other mechanism known in the art. Extending through the apertures may be a ring joined to the cord or the cord may be joined directly to the tabs. Desirably, a swivel is installed between the cord and the object.

The cord should join to the object at a first end and be selectively attached to a user's hand or finger at the other end through a loop. The hand or finger loop may be flexible in size with sufficient range to fit most hand or fingers and may be formed of fabric, plastic or other suitable material. Swivels may be used at points where the cord attaches to the object and/or hand or finger loop.

DETAILED DESCRIPTION OF THE INVENTION

The swinging toy consists of an object 5 and a cord 1. The object includes at least one cavity that may selectively or permanently contain a substance. The object may be any of a variety of shapes, weights and materials. The ideal shape is a cylindrical or elliptical sphere as these shapes are more aerodynamic and are thus safer and easier to move. As depicted in FIG. 1, the preferred object would be a cylindrical sphere of approximately 6¼" inches in total length, although the dimensions may vary considerably. The preferred weight is approximately 6 ounces when empty and approximately 9 ounces when filled with two 4" glow sticks each containing a 12-hour chemiluminescent reaction. While this weight is preferred, the weight may range from several ounces to several pounds.

The preferred material is any material which has suitable characteristics for size, weight and the environment in which the device is used and which is transparent or translucent. A preferred material is plastic and more specifically, a flexible and durable plastic such as urethane foam or vinyl. Other materials such as felt, cotton, polyester or leather may be used, but should be arranged in such a manner as not to hinder the aesthetics of the object.

The object includes at least one cavity, which may be permanently or selectively sealable with end caps. The cavities may range in size and location depending upon the number of cavities desired and aesthetic factors. Preferably, the object has two separate cavities. Preferably, each cavity is 4" in length and ¾" in diameter. The length and diameter of the object without end caps is approximately 4" in length and 1⅜" in diameter. The preferred configuration is depicted in FIG. 1. The cavity may be as large as possible up to, but not including the point where the object starts losing the structural integrity of its walls.

The cavity is sized and shaped to provide space for a substance and to receive either a permanent or selectively removable end cap 6. The seal between the end caps and the object should provide a water tight seal enclosing the cavity. In the preferred embodiment, the end caps include a whistle, which emits sound when the invention is used. Preferably, the object has two selectively removable, padded end caps 6. The preferred end caps are manufactured of foam rubber or other similar padded substance and are approximately 1½" in height and 2¼" in diameter. The selectively removable caps have a threaded molded plastic inner cap 8 that is approximately ½" in height and 1⅝" in diameter embedded in the foam. In the preferred embodiment one of the end caps, the clip end cap, contains a plastic clip 7 in the center from which a decorative tail 4 may be attached. The other end cap, the cord end cap, contains the attachment mechanism for connecting the object to the cord.

The attachment mechanism may be tabs with apertures or other mechanism known in the art. Extending through the apertures may be a ring joined to the cord or the cord may be joined directly to the tabs. Desirably, a swivel in installed between the cord and the object. In its preferred embodiment, the cord is permanently attached to or embedded in the cord end cap.

The cord 1 may be between 12" and 36" in length and should be sufficiently strong to withstand the forces encountered when the object is twirled as described below. Suitable cords include, but not limited to nylon cord, cable, metal chain string, fibrous cord, or other suitable elongated member. Preferably, the cord is woven nylon and approximately 24" in length. The preferred cord I may be adjusted from approximately 24" in length down to 12" in length through the use of an adjustment slide 2. The adjustment slide is preferably made from plastic and is approximately 1½" in length, ½" in width, and ⅛" thick. The slide contains 3 equally spaced holes.

The cord should join to the object at a first end and be selectively attached to a user's hand or finger at the other end. The cord may join to a user's hand or finger through the use of a finger or hand loop 3. The finger or hand loop may be flexible in size with sufficient range to fit most fingers or hands and may be formed of fabric, plastic or other suitable material. Swivels may be used at points where the cord attaches to the object and/or finger or hand loop. Preferably, the hand or finger loop is nylon webbing approximately 8" in length, ¾" in width, and 1 1/16" thick. The hand of finger loop has a metal grommet 11 sewn into it through which the cord is threaded. FIG. 1 depicts this configuration.

The substance contained within the object may be any suitable substance that provides a decorative effect when the toy is in use. Some substances may include colored water, beads which may glow in the dark, chemiluminescent fluid, batteries together with a light, reflective material, e.g, tin foil, chemical compositions that alternate between colors or other such substances, or magnetically powered light sources. In a preferred embodiment, each cavity contains a light stick 9, of approximately 4" in length, filled with a chemiluminescent fluid.

In addition, the toy may contain a tail 4 which is attached to one end of the object. Preferably, the tail is a woven nylon fabric and is approximately 3' in length, 2¼" in width, and 1/32" thick. The tail has a tail attachment cord sewn into a loop and attached onto one of the tails ends. Preferably, the tail attachment cord 12 is approximately 1½" in length. The tail is attached to the object by placing the attachment cord loop around the tail attachment clip located on the clip end cap 7.

The present invention in operation allows a user to remove the selectively removable cap and introduce a desired luminescent substance into the one or more cavities. The cap is then secured to the object forming a watertight seal. The cord may be attached to the object, if not already attached, and the cord may also be secured to a user. The user may also attach a tail to the object, if not already attached. The user may then swing the object around his or her body as shown in FIGS. 2, 3 and 4 forming aesthetically pleasing patterns or light and/color perhaps in rhythmic sequence. Typically, a user will use multiple units, one per arm, when using this toy.

Although the present invention has been described with reference to preferred embodiments, workers skilled in the art will recognize changes may be made in form and detail without departing from the spirit and scope of the invention.

1. Cord

2. Adjustment slide

3. Hand or finger loop

4. Tail

5. Object

6. Endcap

7. End cap tail clip

8. Inner cap

9. Light source

10. Cavities

11. Grommet

Figure 1:
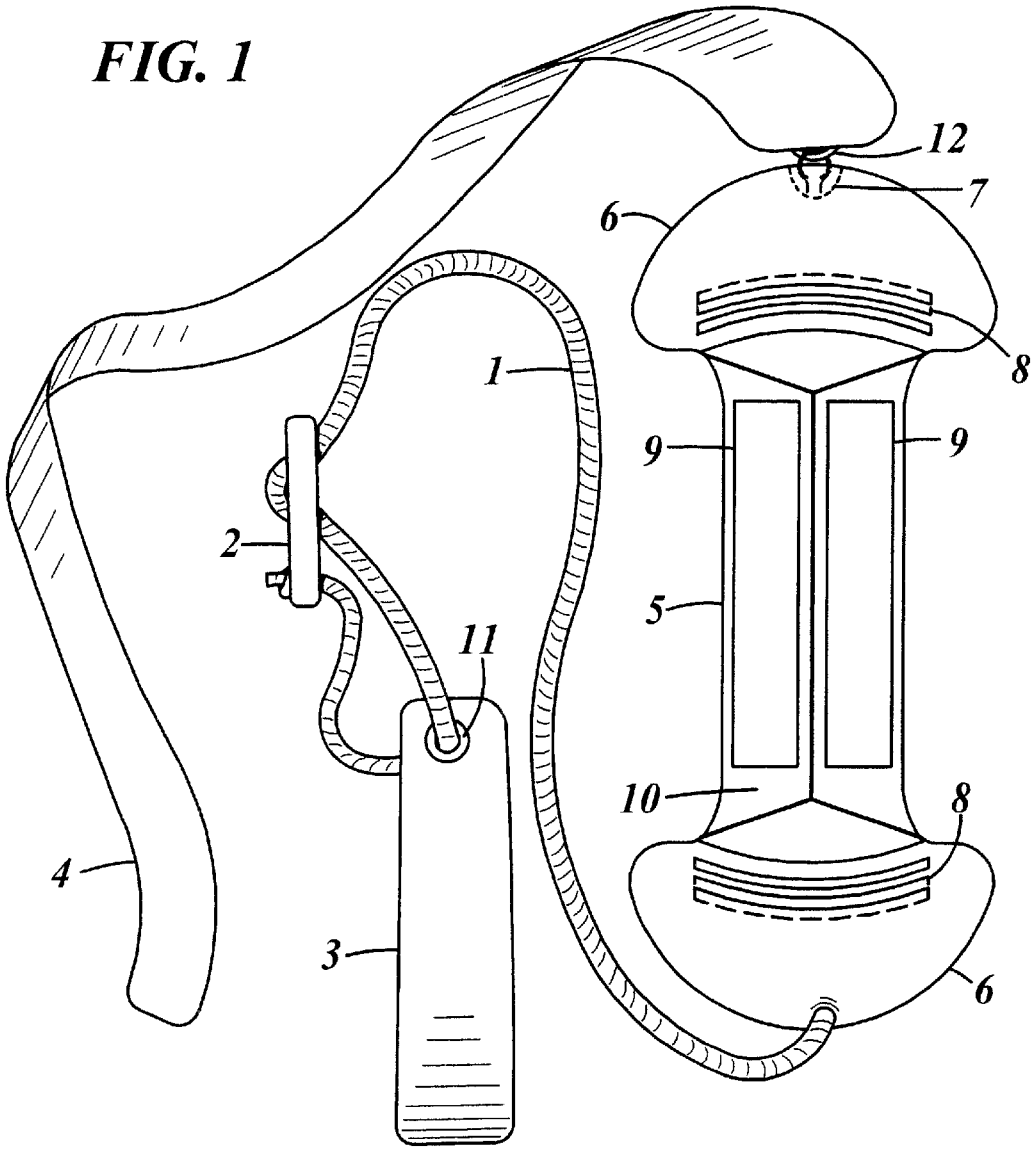
FIG. 1
Figure 2:
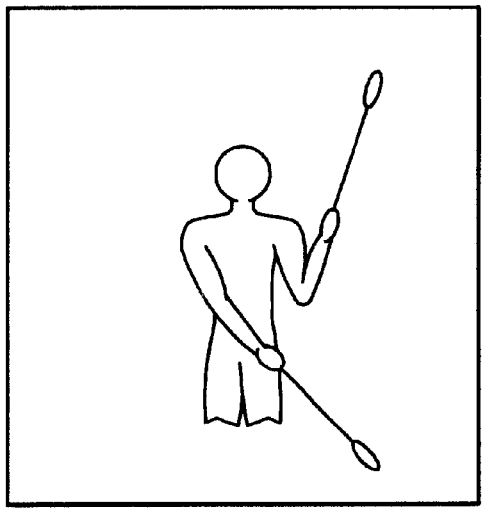
Figure 3:
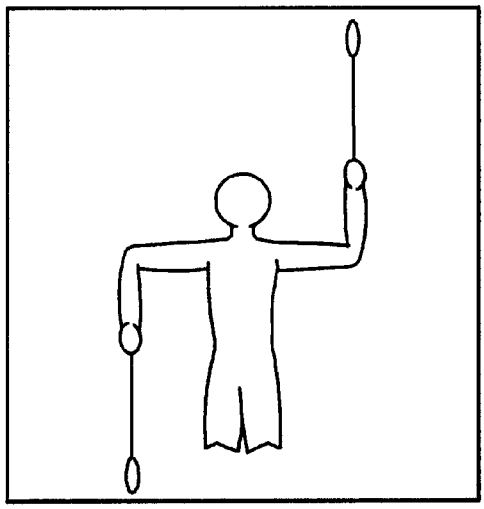
Figure 4:
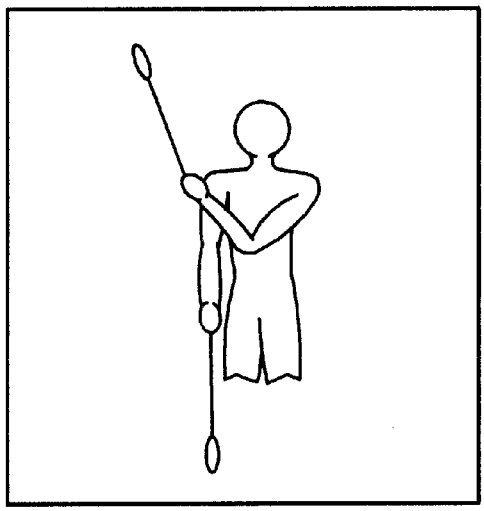

12. Tail attachment cord loop.

FIG. 2

Diagram of the toy in use.

FIG. 3

Diagram of the toy in use.

FIG. 4

Diagram of the toy in use.

I claim:

1. A swinging toy comprised of:

an object with two hollow central cavities;

two end caps selectively sealing said hollow central cavities of said object, one on each end of said object;

a cord attached to one end of said object;

a hand or finger loop attached to the end of said cord.

2. The swinging toy of claim 1, in which said object is cylindrical in shape.

3. The swinging toy of claim 1, in which said object is manufactured from plastic.

4. The swinging toy of claim 1, in which said end caps are manufactured from foam rubber or other similar padded substance and contain inner caps.

5. The swinging toy of claim 4, in which said inner caps are manufactured from a hard plastic and are threaded.

6. The swinging toy of claim 5, in which one of said end caps has a loop to which a decorative tail may be connected and the other of said end caps has said cord attached to it.

7. The swinging toy of claim 6, in which the said decorative tail is manufactured from woven nylon and includes a length of attachment cord on one end which connects said decorative tail to said loop on said end cap.

8. The swinging toy of claim 1, in which said cord is manufactured from woven nylon.

9. The swinging toy of claim 8, in which the length of said cord is adjustable through the use of an adjustment slide.

10. The swinging toy of claim 9, in which said adjustment slide is manufactured from plastic and contains three holes through which said cord passes.

11. The swinging toy of claim 1, in which said cord is permanently attached to one of said end caps.

12. The swinging toy of claim 1, in which said hand or finger loop is manufactured from nylon webbing and contains a grommet through which said cord passes and secures said cord to said hand or finger loop.

13. The swinging toy of claim 1, in which the said cavities contain a light source.

14. The swinging toy of claim 1, in which the said cavities contain light sources.

15. The swinging toy of claim 1, in which said object is elliptical in shape.

16. The swinging toy of claim 1, in which said end cap has a whistle attached to it which emits sound when the toy is used.

* * * * *